US012805655B2

(12) United States Patent
Way

(10) Patent No.: US 12,805,655 B2
(45) Date of Patent: Nov. 24, 2026

(54) FITTED SHEET HAVING AN ELONGATED RETAINING SLEEVE

(71) Applicant: Jessica Way, Carmel, IN (US)

(72) Inventor: Jessica Way, Carmel, IN (US)

( * ) Notice: Subject to any disclaimer, the term of this patent is extended or adjusted under 35 U.S.C. 154(b) by 0 days.

(21) Appl. No.: 19/025,143

(22) Filed: Jan. 16, 2025

(65) Prior Publication Data

US 2025/0235017 A1 Jul. 24, 2025

Related U.S. Application Data

(60) Provisional application No. 63/622,695, filed on Jan. 19, 2024.

(51) Int. Cl.
*A47G 9/02* (2006.01)
*A47C 21/08* (2006.01)

(52) U.S. Cl.
CPC ..... *A47G 9/0246* (2013.01); *A47C 21/08* (2013.01)

(58) Field of Classification Search
CPC .. A47G 9/0246; A61G 7/0525; A47D 15/005; A47D 15/008
See application file for complete search history.

(56) References Cited

U.S. PATENT DOCUMENTS 2,528,313 A 10/1950 Kessler
2,569,627 A 10/1951 Black
2,624,893 A 1/1953 Harris
2,639,444 A 5/1953 De Monsabert
2,942,280 A 6/1960 May
3,273,175 A 9/1966 Anderson et al.
3,789,441 A 2/1974 Weiss
4,607,402 A * 8/1986 Pollard ..... A47D 15/008 D6/333
4,672,702 A 6/1987 Isham
4,872,228 A * 10/1989 Bishop ..... A47D 15/008 5/513
4,873,734 A * 10/1989 Pollard ..... A47D 15/008 5/946
5,325,555 A 7/1994 Whitley
5,542,135 A 8/1996 Ozrovitz et al.
5,996,148 A 12/1999 McCain et al.
6,499,157 B1 12/2002 McCain et al.
6,848,130 B1 * 2/2005 Wilson ..... A47C 21/08 5/427

(Continued)

*Primary Examiner* — David E Sosnowski
(74) *Attorney, Agent, or Firm* — Daniel F. Nesbitt; Nesbitt IP LLC

(57) ABSTRACT

A fitted sheet for use on a mattress that retains an elongated foam cylinder for preventing a child or other vulnerable person from rolling off a side of the mattress. The sheet fabric has a retaining sleeve attached to the outward surface. The retaining sleeve has a first pocket and a second pocket, each pocket made of a pocket fabric having first and second opposed lateral edges fixed along the length to the sheet fabric to provide an elongated space between the pocket fabric and the sheet fabric. The first and second pockets align along a common axis with the open end of the first pocket overlapping the open end of the second pocket to form an enclosed elongated space within the retaining sleeve. The open ends can be manually separated to insert the elongated foam cylinder, to retain the elongated foam cylinder with the retaining sleeve.

13 Claims, 4 Drawing Sheets

(56) References Cited

U.S. PATENT DOCUMENTS

| | | | | |
|---|---|---|---|---|
| 7,743,442 | B2 * | 6/2010 | Maloney | A47D 15/001 446/72 |
| 7,904,977 | B1 * | 3/2011 | Singh | A47G 9/0246 5/497 |
| 11,324,332 | B1 * | 5/2022 | Flannery | A47C 21/08 |
| 2008/0078029 | A1 | 4/2008 | Seago | |
| 2008/0163424 | A1 | 7/2008 | Mobley | |
| 2010/0154127 | A1 * | 6/2010 | Walter | A47G 9/0246 5/497 |
| 2010/0223726 | A1 * | 9/2010 | Maloney | A47D 15/001 5/500 |
| 2010/0287702 | A1 * | 11/2010 | Rie | A61G 7/051 5/600 |
| 2011/0296612 | A1 * | 12/2011 | Papp | A47D 15/008 5/424 |
| 2012/0011651 | A1 * | 1/2012 | Moss | A47C 21/08 5/424 |
| 2014/0115862 | A1 | 5/2014 | Sommer | |
| 2015/0245717 | A1 * | 9/2015 | Edmondson | A47C 21/08 5/425 |
| 2016/0000229 | A1 * | 1/2016 | Edmondson | A47C 20/023 5/425 |
| 2018/0110342 | A1 * | 4/2018 | Moss | A47C 27/082 |
| 2023/0051677 | A1 * | 2/2023 | Goron | A47G 9/0253 |

* cited by examiner

FITTED SHEET HAVING AN ELONGATED RETAINING SLEEVE

CROSS-REFERENCE TO RELATED APPLICATION

The present application claims the benefit of U.S. Provisional Application No. 63/622,695 filed on Jan. 19, 2024, the entirety of which is hereby incorporated by reference.

FIELD OF THE INVENTION

The invention relates to bedding that serves to protect a sleeping person vulnerable to injury, especially adult seniors, the handicapped, and children over 24 months old, from falling inadvertent from the bed.

BACKGROUND

Senior-care facilities, hospitals, in-home care and the like, commonly deal with incidents where their elderly patients and/or loved ones injure themselves by inadvertently falling out of bed. Additionally, parents of young children commonly consider the safety of their children's beds as the children begin to sleep in their own beds. One example is how to minimize the situations for the child to fall off the bed, such as off a side of the bed from rolling off the bed while they are asleep.

Bedrails and other guardrails are commonly installed, where the bedrail is anchored along each longitudinal side of the bed, such as between the mattress and box spring of the bed, and adjusted to an adequate height to provide a barrier for the such vulnerable sleepers from inadvertently going over the side of the bed and falling. Some bedrails might be difficult to install and uninstall quickly. They are also very conspicuous on a bed and may appear imposing.

SUMMARY OF THE INVENTION

The present invention provides a fitted sheet for use on a mattress (feature <1>, the fitted sheet comprising: (i) a sheet fabric having an outward surface facing away from the mattress, and (ii) a retaining sleeve attached to the outward surface, comprising a first pocket and a second pocket, each pocket made of a pocket fabric having a length, a first lateral edge and a second lateral edge opposite the first lateral edge, a closed first end, and an open second end, wherein the first and second opposed lateral edges are fixed along the length of the pocket fabric to the outward surface of the sheet fabric to provide an elongated space between the pocket fabric and the sheet fabric, wherein the first pocket and the second pocket are aligned along a common axis, the open end of the first pocket confronts, and preferably overlaps, or is overlapped by, the open end of the second pocket to form an enclosed elongated space within the retaining sleeve, and wherein the open ends of the first and second pockets can be manually separated to provide a temporary opening into the elongated spaces of the first pocket and the second pocket sufficient to insert the respective ends of an elongated barrier, such as an elongated cylinder, to retain the elongated cylinder within the retaining sleeve.

In various embodiments, the fixed first and second lateral edges of the pocket fabric are parallel and spaced apart, and fixed separately to the sheet fabric.

In various embodiment, the width of the pocket fabric between the lateral edges is at least 20% more than the width on the outward surface of the sheet fabric where the opposed lateral edges of the respective pocket are fixed to the outward surface of the sheet fabric.

In various embodiments, the length of the second pocket is at least 1% and up to 33% of the length of the first pocket.

In various embodiments, an affixment of the two elongated enclosable pockets to the outward surface of the sheet fabric comprises one or more of stitching, a glue, a bonding tape, a mechanical fastener, or a combination thereof.

In various embodiments, the pocket fabrics and the sheet fabric comprise the same fabric type.

In various embodiments, the closed first ends are enclosed by an end panel fixed along the first end edge of the pocket fabric. The shape of the end panel can be any planar shape, preferably to accommodate a corresponding geometric shape of the elongated barrier.

In various embodiments, the retaining sleeve is fixed along one lateral edge of the sheet fabric, and further including a second retaining sleeve fixed along an opposite lateral edge of the sheet fabric.

In various embodiments, the elongated barrier can have any shape along with length.

In some embodiments, the cross-sectional shape of the elongated barrier can be any one or a combination of circular, rectangular, square, triangular, oval, and a domed shape (a bell-shaped surface opposite a flat surface). In some embodiments, the elongated barrier is an elongated cylinder having the same cross-sectional shape along its length. In a preferred embodiment, the elongated cylinder is a circular cylinder, a square cylinder or a domed cylinder (an elongated cylinder having a uniform domed-shaped cross section). In various embodiments, the elongated barrier or cylinder is made of a porous foam polymer material, or an inflated plastic cylinder.

The elongated barrier comprises a resilient structure that requires a user to exert a manual force to bend the structure from its natural shape, for insertion of the elongated barrier into the retaining sleeve. In some embodiments, the elongated barrier has a resilient shape that will return to its original liner shape after a bending force is released.

The present invention also includes a method for covering a mattress with a fitted sheet that retains an elongated barrier for preventing a vulnerable sleeper, for example a child, from rolling off a side of the mattress. The method comprises: a) providing a fitted sheet, configured according to feature <1>, and an elongated barrier; b) covering the mattress with the fitted sheet; c) manually grasping the respective open ends of the first and second pockets of the second retaining sleeve and pulling them axially toward their respective closed ends; d) inserting one end of the elongated barrier into the open end of the first pocket, and into, preferably fully into, the elongated space of the first pocket; and e) folding over the opposite end of the elongated barrier and inserting opposite end of an elongated barrier into the open end of the second pocket and into the elongated space of the second pocket, thereby retaining the elongated barrier within the retaining sleeve.

In some embodiments, the fitted sheet is configured to include a second retaining sleeve, typically parallel to and spaced apart from the first retaining sleeve, and the method further includes the steps of: f) providing a second elongated barrier; g) manually grasping the respective open ends of the first and second pockets of the second retaining sleeve and pulling them axially toward their respective closed ends; h) inserting one end of the second elongated barrier into the open end of the first pocket, and into, preferably fully into, the elongated space of the first pocket; and i) folding over the opposite end of the second elongated barrier and inserting the opposite end of an elongated barrier into the open end of the second pocket and into the elongated space of the second pocket, thereby retaining the second elongated barrier within the second retaining sleeve. The second retaining sleeve can be parallel to, and disposed on an opposite side of the fitted sheet from, the first retaining sleeve, to provide a sleep area between the two retaining sleeves.

In some embodiments, the fitted sheet is configured to include a third retaining sleeve, typically parallel to and disposed between the first and second retaining sleeves, to provide two sleep areas between adjacent retaining sleeves.

DETAILED DESCRIPTION OF THE INVENTION

Figure 1:
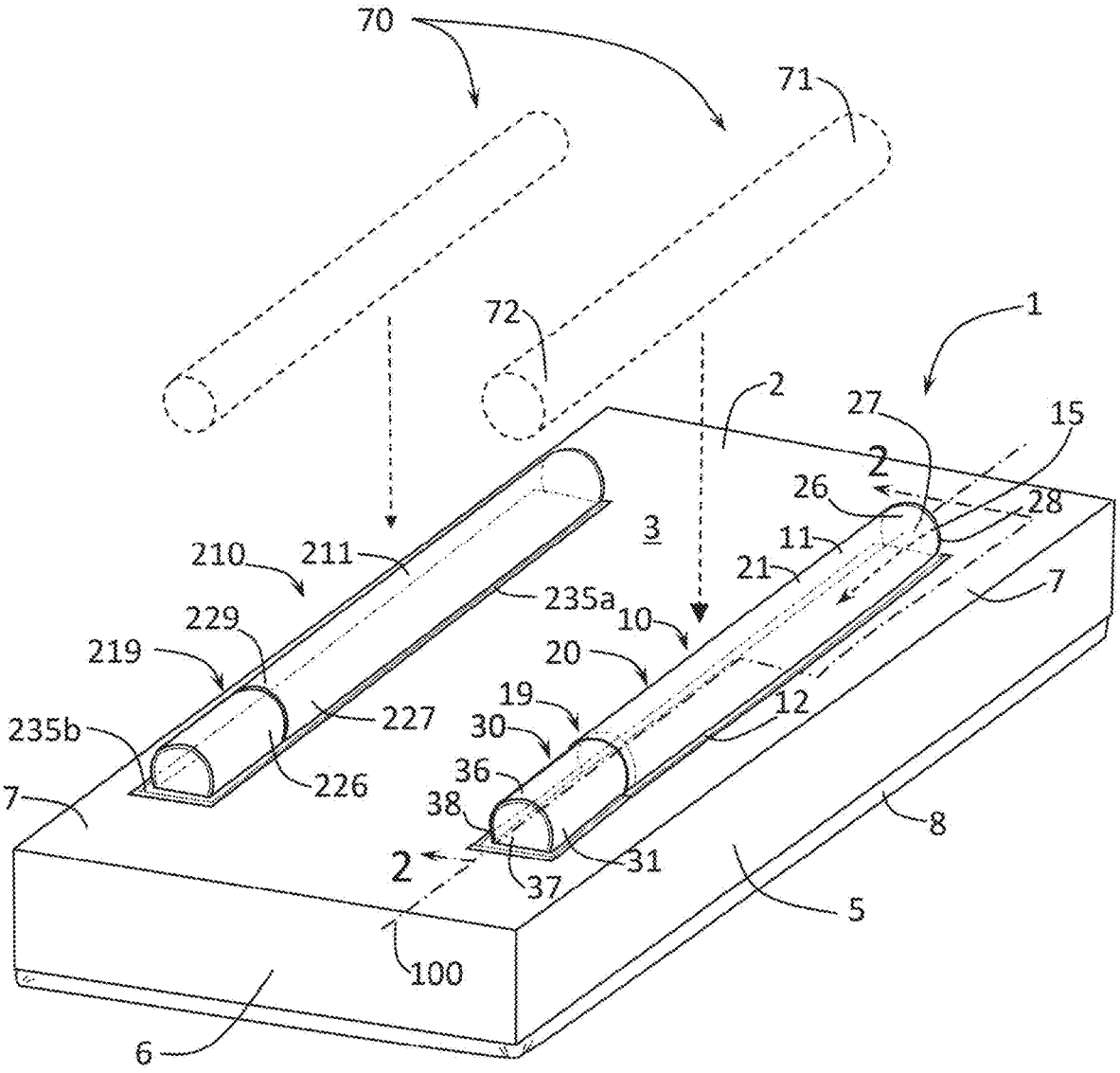
FIG. 1 illustrates a perspective view of a fitted sheet covering a mattress, the fitted sheet having two elongated retaining sleeves along opposite lateral sides of the upper surface of the fitted sheet, each retaining sleeve having a first pocket and a second pocket with an intermediate opening therebetween for inserting and retaining an elongated barrier.
Figure 2:
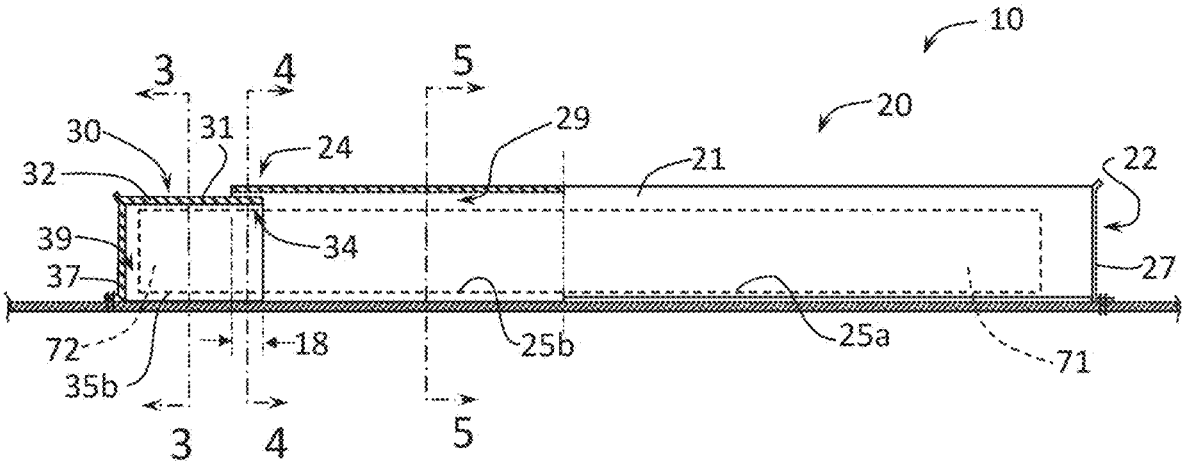
FIG. 2 illustrates a sectional view along the length of one of the retaining sleeves on the fitted sheet, taken along line 2-2 of FIG. 1, depicting the elongated barrier therewithin.

FIGS. 1 and 2 illustrates a fitted sheet 1 fitted onto a mattress 8. The fitted sheet 1 is a sheet fabric 2 having an outward surface 3 facing away from an upper surface of the mattress 8. The fitted sheet includes opposed side panels 5 and opposed end panels 6 that extend over the respective sides and ends of the mattress 8, to secure the fitted sheet 1 to the mattress 3. The fitted sheet 1 also includes a retaining sleeve 10 attached to the outward surface 3, typically along and parallel to one of the lateral side edges of the sheet fabric 2. The retaining sleeve 10 consists of an elongated tube of a sleeve fabric 11, with the lateral edges 12 of the sleeve fabric 11 fixed to the outward surface 3 of the sheet fabric 2. The retaining sleeve 10 has an intermediate opening 19 through which the opposite ends of an elongated barrier 70, a non-limiting example of which is an elongated foam cylinder, can be inserted into the interior space 15 of the retaining sleeve 10, to retain the elongated barrier 70 within the retraining sleeve.

A fitted sheet can be made with the features of a standard mattress sheet that is well known in the art. Non-limiting examples of standard mattress sheets are described in U.S. Pat. No. 2,528,313 (Kessler), U.S. Pat. No. 2,569,627 (Black), U.S. Pat. No. 2,624,893 (Harris), U.S. Pat. No. 2,639,444 (Monsabert), U.S. Pat. No. 2,942,280 (May), U.S. Pat. No. 3,273,175 (Anderson), U.S. Pat. No. 3,789,441 (Weiss), U.S. Pat. No. 4,672,702 (Isham), U.S. Pat. No. 5,325,555 (Whitley), and U.S. Pat. No. 6,499,157 (McCain), and US Patent Publication 2008-0078029 (Seago), the disclosures of which are incorporated by reference in their entireties.

In a preferred embodiment, retaining sleeve 10 includes a first pocket 20 and a second pocket 30, each fixed to the outward surface 3 of the sheet fabric 2.

Figure 3:
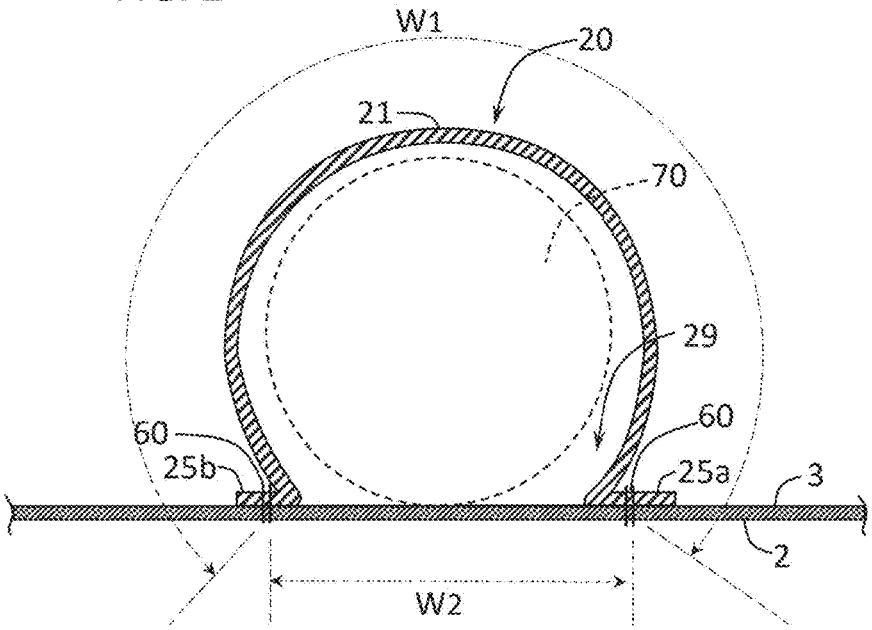
FIG. 3 illustrates a cross-sectional view through the second pocket of the retaining sleeve, taken along line 3-3 of FIG. 2.
Figure 4:
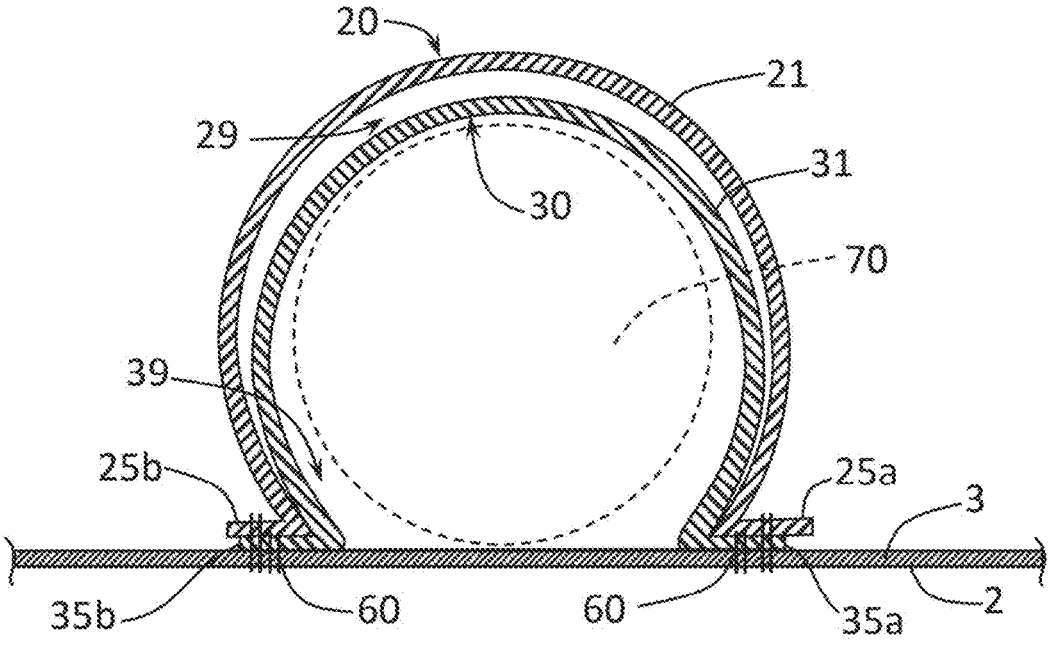
FIG. 4 illustrates a cross-sectional view through the overlap of the second pocket with the first pocket, taken along line 3-3 of FIG. 2.
Figure 5:
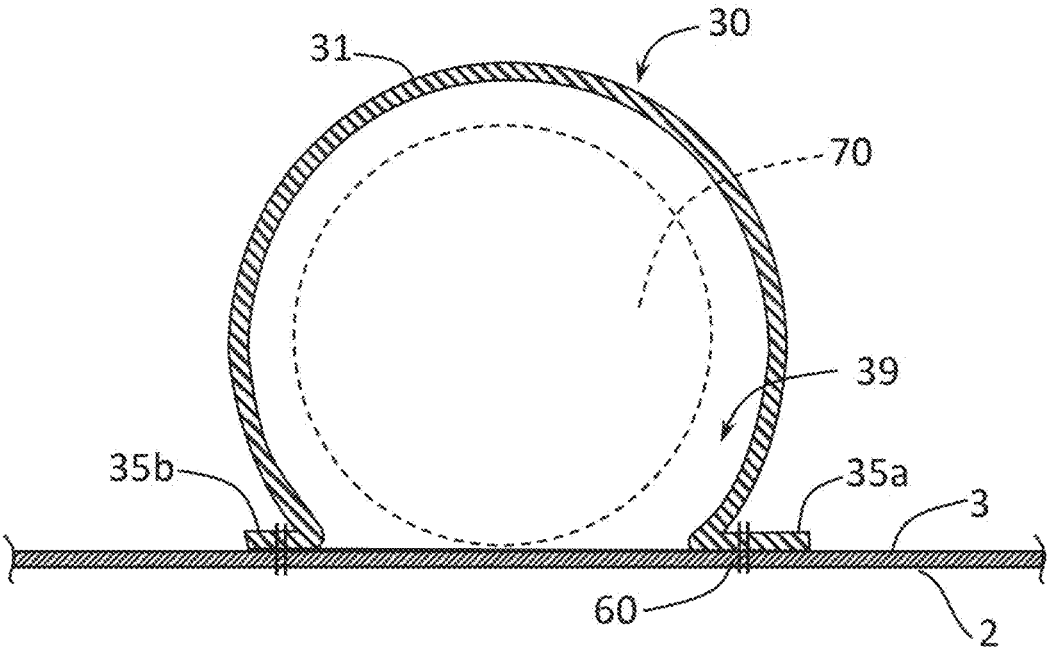
FIG. 5 illustrates a cross-sectional view through the second pocket of the retaining sleeve, taken along line 5-5 of FIG. 2.

Cross-sectional views of the first pocket 20 and the second pocket 30 are shown in FIGS. 3-5. The first pocket 20, shown in cross section in FIG. 3, is made of a pocket fabric 21, and has a length, a closed first end 22, and an open second end 24. The pocket fabric 21 has a first lateral edge 25*a* and a second lateral edge 25*b* that are fixed along the length of the pocket fabric 21 to the outward surface 3 of the sheet fabric 2. The width of the pocket fabric 21 is sufficient to provide the first pocket 20 with an elongated space 29 between the pocket fabric 21 and the sheet fabric 11.

The second pocket 30, shown in cross section in FIG. 5, is also made of a pocket fabric 31, and has a length, a closed first end 32, and an open second end 34. The pocket fabric 31 has a first lateral edge 35*a* and a second lateral edge 35*b* that are fixed along the length of the pocket fabric 31 to the outward surface 3 of the sheet fabric 2. The width of the pocket fabric 31 is sufficient to provide the second pocket 30 with an elongated space 39 between the pocket fabric 31 and the sheet fabric 11.

The first pocket 20 and the second pocket 30 are aligned along a common axis 100, with the open end 22 of the first pocket 20 adjacent to, and preferably overlapping axially, or being overlapped axially by, the open end 32 of the second pocket 30. The open ends 24,34 of the first and second pockets 20,30 confront one another, and together form an enclosed elongated space 15 within the retaining sleeve 10. Preferably, the overlap 18 (see FIG. 2) is about 1 cm to about 5 cm.

In a method of the present invention, and in a use of the fitted sheet 1, the open ends 24,34 the open end 22 of the first and second pockets 20,30 can be manually grasped and separated to provide a temporary opening into the elongated spaces 29,39 of the first and second pockets 20,30 that is sufficient to insert respective ends 71,72 of the elongated barrier 70.

Preferably, the first and second pockets 20,30 of the retaining sleeve 10 are along a lateral edge 7 of the sheet fabric 2.

In various embodiments as illustrated, the fitted sheet 1 includes first and second retaining sleeves 10, fixed along opposite lateral edges 7 of the sheet fabric 2.

In the illustrated embodiment, the width (W1, shown in FIG. 3) of the pocket fabric 21 (and likewise for pocket fabric 31) between the lateral edges 25*a*,25*b* of the formed loop, is at least 20% more than the width (W2) on the outward surface 3 of the sheet fabric 2 where the opposed lateral edges 25*a*,25*b*, 35*a*,35*b* of the respective pockets 20,30 are fixed to the outward surface 3 of the sheet fabric 2. The spacing apart of the opposed lateral edges 25*a*,25*b* and 35*a*,35*b* is typically at least about 2 inches and up to about 10 inches, and more typically about 4 inches and up to about 8 inches, to accommodate the diameter of an elongated foam cylinder.

In the illustrated embodiment, the length of the second pocket 30 is at least about 1% and up to about 33% of the length of the first pocket 20, preferably at least about 5% and up to about 20%.

In various embodiments, an affixment 60, used to fix the two elongated, closable pockets 20,30 to the outward surface 3 of the sheet fabric 2, comprises one or more of stitching, a glue, a bonding tape, or a mechanical fastener; preferably, stitching.

In various embodiments, the pocket fabric of the two pockets and the sheet fabric are the same fabric type.

In the illustrate embodiment, the first end 22 of the first pocket 20 is enclosed by an end panel 27 that has a curved edge 28 that is fixed along the closed end edge 26 of the pocket fabric 21. And the first end 32 of the second pocket 30 is enclosed by an end panel 37 that has a curved edge 38 that is fixed along the closed end edge 36 of the pocket fabric 31.

In various embodiments, the elongated barrier 70 is an elongated cylinder made of a porous foam plastic material.

In various embodiments, the length of the enclosed elongated space 15 within the retaining sleeve 10 is at least as long, and preferably longer, than the length of the elongated barrier 70.

Figure 6:
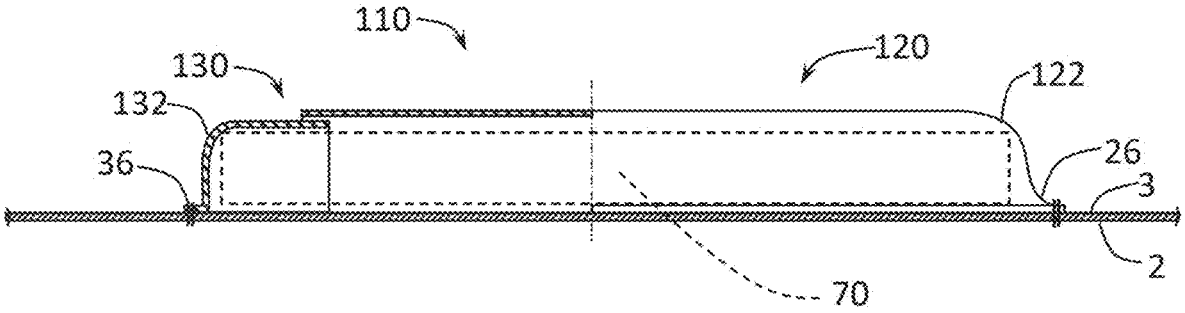
FIG. 6 depicts an alternative embodiment of a retaining sleeve.

In an alternative embodiment shown in FIG. 6, a closed end 122 of the first pocket 120 can be formed by fixing the closed end edge 26 directly to the sheet fabric 2, and a closed end 132 of the second pocket 130 can be formed by fixing the closed end edge 36 directly to the sheet fabric 2.

In an alternative embodiment, shown in FIG. 1, an elongated retaining sleeve 210 can consist of a single sleeve fabric 211 with respective close ends and lateral edges as described herein, having an intermediate opening 219 formed into the sleeve fabric along the length of the sleeve 210. The intermediate opening 219 can be formed by a linear opening 225 along the width of the sleeve fabric, substantially to, but not through, the opposed lateral edges 235*a*, 235*b*, to form a first opening edge 226 and a second opening edge 227.

The present invention also provides a method for preparing a mattress with a fitted sheet containing an elongated foam cylinder for prevent a child from rolling off a side of the mattress. The method comprises the steps of providing a fitted sheet comprising a retaining sleeve as described herein, and an elongated foam cylinder. The fitted sheet is placed onto the mattress in traditional fashion. The empty retaining sleeve is then opened by manually grasping the respective open ends of the first and second pockets of the retaining sleeve and pulling the open ends apart, axially toward their respective closed ends, to form a temporary opening. One end of the elongated foam cylinder is then inserted to the temporary opening and into the open end of the first pocket, and slid fully into the elongated space of the first pocket. The exposed second opposite end of the elongated barrier is then folded over using manual force, away from the axis elongated barrier, and inserted into the open end of the second pocket and into the elongated space of the second pocket.

In the alternative embodiment of retaining sleeve 210, the empty retaining sleeve 210 is opened by manually grasping the respective open ends of the first and second pockets of the retaining sleeve and pulling the open ends apart, axially toward their respective closed ends, to form a temporary opening.

In some embodiments the sheet fabric and the sleeve fabrics can be cotton or cotton-like fibers, or microfiber, preferably cotton.

Elongated barriers, including elongated foam cylinders, may comprise a resilient structure, that is, a structure on which a user must exert at least a minimal force and effort upon, to bend the structure from its natural shape, and will return to its original liner shape after the bending force for bending is released. The elongated foam cylinder can comprise a lightweight and/or porous material, such as porous thermoplastic foam or other lightweight materials. Non-limiting examples of suitable elongated foam cylinders are commonly referred to as pool noodles and foam blocks (e.g., yoga bolster), and the like. Preferably, the elongated foam cylinder is a pool noodle of suitable length.

It is understood that modifications to the invention may be made as might occur to one with skill in the field of the invention within the scope of the appended claims. All embodiments contemplated here that achieve the benefits of the invention have therefore not been shown in complete detail. Other embodiments may be developed without departing from the spirit of the invention or from the scope of the appended claims.

The invention claimed is:

1. A fitted sheet for use on a mattress comprising:

(i) a sheet fabric having an outward surface facing away from the mattress, and (ii) a retaining sleeve attached to the outward surface, comprising a first pocket and a second pocket, each pocket made of a pocket fabric having a length, a first lateral edge and a second lateral edge opposite the first lateral edge, a closed first end, and an open second end, wherein the first and second opposed lateral edges are fixed along the length of the pocket fabric to the outward surface of the sheet fabric to provide an elongated space between the pocket fabric and the sheet fabric, wherein the first pocket and the second pocket are aligned along a common axis, the open end of the first pocket overlaps axially, or is overlapped axially by, the open end of the second pocket to form an enclosed elongated space within the retaining sleeve, and wherein the open ends of the first and second pockets can be manually separated to provide a temporary opening into the elongated spaces of the first pocket and the second pocket sufficient to insert the respective ends of an elongated barrier, to retain the elongated barrier within the retaining sleeve.

2. The fitted sheet of claim 1 wherein the fixed first and second lateral edges of the pocket fabric are parallel and spaced apart, and fixed separately to the sheet fabric.

3. The fitted sheet of claim 2 wherein the width of the pocket fabric between the lateral edges is at least 20% more than the width on the outward surface of the sheet fabric where the opposed lateral edges of the respective pocket are fixed to the outward surface of the sheet fabric.

4. The fitted sheet of claim 1 wherein the length of the second pocket is at least 1% and up to 33% of the length of the first pocket.

5. The fitted sheet of claim 1 wherein an affixment of the two elongated enclosable pockets to the outward surface of the sheet fabric comprises one or more of stitching, a glue, a bonding tape, a mechanical fastener, or a combination thereof.

6. The fitted sheet of claim 1 wherein the pocket fabrics and the sheet fabric comprise the same fabric type.

7. The fitted sheet of claim 1 wherein the closed first ends of the first pocket and the second pocket are each enclosed by an end panel fixed along the first end edge of the pocket fabric.

8. The fitted sheet of claim 1 where the retaining sleeve is fixed along one lateral edge of the sheet fabric, and further including a second retaining sleeve fixed along an opposite lateral edge of the sheet fabric.

9. The fitted sheet of claim 1, further including the elongated barrier, wherein the elongated barrier comprises an elongated cylinder made of a porous foam plastic material.

10. The fitted sheet of claim 1 further including a second retaining sleeve, the retaining sleeve and the second retaining sleeve being fixed along opposite lateral edges of the sheet fabric.

11. A method for covering a mattress with a fitted sheet that retains an elongated barrier for preventing a vulnerable person from rolling off a side of the mattress, the method comprising:

a) providing a fitted sheet, configured according to claim 1 and an elongated barrier;

b) covering the mattress with the fitted sheet;

c) manually grasping the respective open ends of the first and second pockets of the second retaining sleeve and pulling them axially toward their respective closed ends;

d) inserting one end of the elongated barrier into the open end of the first pocket and fully into the elongated space of the first pocket; and e) folding over the opposite end of the elongated barrier and inserting opposite end of an elongated barrier into the open end of the second pocket and into the elongated space of the second pocket, thereby retaining the elongated barrier within the retaining sleeve.

12. The method of claim 11 wherein the fitted sheet is configured according to claim 10, and further including the steps of:

f) providing a second elongated barrier;

g) manually grasping the respective open ends of the first and second pockets of the second retaining sleeve and pulling them axially toward their respective closed ends;

h) inserting one end of the second elongated barrier into the open end of the first pocket and fully into the elongated space of the first pocket; and i) folding over the opposite end of the second elongated barrier and inserting the opposite end of an elongated barrier into the open end of the second pocket and into the elongated space of the second pocket, thereby retaining the second elongated barrier within the second retaining sleeve.

13. The fitted sheet of claim 4 wherein the length of the second pocket is at least 5% and up to 20% of the length of the first pocket.

* * * * *